US007694608B2

(12) United States Patent
Squier et al.

(10) Patent No.: US 7,694,608 B2
(45) Date of Patent: Apr. 13, 2010

(54) METHOD OF MANUFACTURING A MATRIX BODY DRILL BIT

(75) Inventors: Brian D. Squier, Splendora, TX (US); James Layne Larsen, Spring, TX (US); Dwayne P. Terracina, Spring, TX (US); Timothy Scott Roberts, Conroe, TX (US)

(73) Assignee: Smith International, Inc., Houston, TX (US)

( * ) Notice: Subject to any disclaimer, the term of this patent is extended or adjusted under 35 U.S.C. 154(b) by 674 days.

(21) Appl. No.: 11/313,290

(22) Filed: Dec. 20, 2005

(65) Prior Publication Data

US 2007/0143086 A1 Jun. 21, 2007

(51) Int. Cl.
*B21K 5/02* (2006.01)

(52) U.S. Cl. ..... 76/108.2; 175/339; 700/197

(58) Field of Classification Search ..... 76/108.1, 76/108.2; 175/336, 411, 425, 426, 339; 700/197
See application file for complete search history.

(56) References Cited

U.S. PATENT DOCUMENTS

| | | | |
|---|---|---|---|
| 1,738,860 | A | 12/1929 | Wigle |
| 2,963,102 | A | 12/1960 | Smith |
| 3,014,544 | A | 12/1961 | Steen |
| 3,111,179 | A | 11/1963 | Albers et al. |
| 3,129,777 | A | 4/1964 | Haspert |
| 3,220,754 | A | 11/1965 | Mori |
| 3,358,783 | A | 12/1967 | Raynal et al. |
| 3,605,923 | A | 9/1971 | Feenstra |
| 3,645,346 | A | 2/1972 | Miller et al. |
| 4,174,759 | A | 11/1979 | Arbuckle |
| 4,391,339 | A | 7/1983 | Johnson, Jr. et al. |
| 4,392,534 | A | 7/1983 | Miida |
| 4,505,342 | A | 3/1985 | Barr et al. |
| 4,533,004 | A | 8/1985 | Ecer |
| 4,542,798 | A | 9/1985 | Madigan |
| 4,567,954 | A | 2/1986 | Voight, III et al. |
| 4,603,750 | A | 8/1986 | Sorenson |
| 4,640,375 | A | 2/1987 | Barr et al. |
| 4,665,999 | A | 5/1987 | Shoemaker |
| 4,676,324 | A | 6/1987 | Barr et al. |

(Continued)

FOREIGN PATENT DOCUMENTS

| | | | |
|---|---|---|---|
| EP | 0 669 449 | A2 | 6/1996 |

(Continued)

OTHER PUBLICATIONS

United Kingdom Combined Search and Examination Report dated Jun. 29, 2007, issued in Application No. GB0625087.2 (8 pages).

(Continued)

*Primary Examiner*—Hwei-Siu C Payer
(74) *Attorney, Agent, or Firm*—Osha • Liang LLP

(57) ABSTRACT

A method of manufacturing an earth-boring bit having a fluid plenum and a plurality of fluid pathways includes modeling flow characteristics of the fluid plenum and the plurality of fluid pathways, optimizing the flow characteristics to minimize fluid separation through each fluid pathway, constructing a plenum blank from the optimized model, and sintering matrix power between the plenum blank and a bit head mold to create the fluid plenum and plurality of fluid pathways.

16 Claims, 10 Drawing Sheets

U.S. PATENT DOCUMENTS

| | | | | |
|---|---|---|---|---|
| 4,687,066 | A | 8/1987 | Evans | |
| 4,687,067 | A | 8/1987 | Smith et al. | |
| 4,727,946 | A | 3/1988 | Barr et al. | |
| 4,739,845 | A | 4/1988 | Dennis | |
| 4,775,017 | A | 10/1988 | Forrest et al. | |
| 4,794,995 | A | 1/1989 | Matson et al. | |
| 4,886,131 | A | 12/1989 | Cholet et al. | |
| 5,173,880 | A | 12/1992 | Duren et al. | |
| 5,414,674 | A | 5/1995 | Lichman | |
| 5,433,280 | A * | 7/1995 | Smith | 175/336 |
| 5,494,122 | A | 2/1996 | Larsen et al. | |
| 5,579,855 | A | 12/1996 | Dickey | |
| 5,583,825 | A | 12/1996 | Carrazzone et al. | |
| 5,662,183 | A | 9/1997 | Fang | |
| 5,669,459 | A | 9/1997 | Larsen et al. | |
| 5,671,136 | A | 9/1997 | Willhoit, Jr. | |
| 5,956,561 | A | 9/1999 | Bugle et al. | |
| 5,966,672 | A | 10/1999 | Knupp | |
| 5,992,763 | A | 11/1999 | Smith et al. | |
| 6,089,123 | A * | 7/2000 | Chow et al. | 76/108.2 |
| 6,098,728 | A | 8/2000 | Wells et al. | |
| 6,135,218 | A | 10/2000 | Deane et al. | |
| 6,142,248 | A | 11/2000 | Thigpen et al. | |
| 6,186,251 | B1 | 2/2001 | Butcher | |
| 6,209,420 | B1 | 4/2001 | Butcher et al. | |
| 6,227,316 | B1 | 5/2001 | Rohde | |
| 6,311,793 | B1 | 11/2001 | Larsen et al. | |
| 6,353,771 | B1 * | 3/2002 | Southland | 700/197 |
| 6,390,212 | B1 | 5/2002 | Wood | |
| 6,581,702 | B2 | 6/2003 | Dickey | |
| 6,655,481 | B2 * | 12/2003 | Findley et al. | 175/425 |
| 6,698,538 | B2 | 3/2004 | Kristiansen et al. | |
| 7,040,423 | B2 * | 5/2006 | Larsen et al. | 175/339 |
| 7,325,632 | B2 * | 2/2008 | Larsen et al. | 175/339 |
| 2001/0030066 | A1 | 10/2001 | Clydesdale et al. | |
| 2002/0050408 | A1 | 5/2002 | Nackerud | |
| 2002/0092684 | A1 | 7/2002 | Singh et al. | |
| 2002/0108752 | A1 | 8/2002 | Morey et al. | |
| 2002/0112889 | A1 | 8/2002 | Larsen | |
| 2002/0148649 | A1 | 10/2002 | Dickey | |
| 2003/0010532 | A1 | 1/2003 | Kristiansen et al. | |
| 2003/0019333 | A1 | 1/2003 | Scott | |
| 2003/0164250 | A1 | 9/2003 | Wardley | |
| 2003/0192718 | A1 | 10/2003 | Buckman et al. | |
| 2004/0069534 | A1 | 4/2004 | Larsen et al. | |
| 2004/0069540 | A1 | 4/2004 | Kriesels et al. | |
| 2004/0226751 | A1 | 11/2004 | McKay et al. | |
| 2004/0238224 | A1 | 12/2004 | Runia | |
| 2004/0238225 | A1 * | 12/2004 | Larsen et al. | 175/340 |
| 2007/0143086 | A1 * | 6/2007 | Roberts et al. | 703/7 |

FOREIGN PATENT DOCUMENTS

| | | | |
|---|---|---|---|
| EP | 0 669 449 | A3 | 6/1996 |
| EP | 0 790 386 | A2 | 8/1997 |
| GB | 2 277 758 | A | 11/1994 |
| GB | 2 290 813 | A | 1/1996 |
| GB | 2295839 | A | 6/1996 |
| GB | 2296673 | A | 7/1996 |
| GB | 2 324 109 | A | 10/1998 |
| GB | 2 348 393 | A | 10/2000 |
| GB | 2 384 014 | A | 7/2003 |
| GB | 2411418 | | 8/2005 |
| GB | 2429729 | A | 3/2007 |
| WO | WO-02/090707 | A2 | 11/2002 |

OTHER PUBLICATIONS

Search and Examination Report dated Jun. 6, 2008 issued by the UK Intellectual Property Office in corresponding Application No. GB0803104.9, 7 pages.

Official Action for Canadian Application No. 2,571,697, dated Jul. 16, 2009, (2 pages).

Examination Report dated Nov. 27, 2008 issued by the Canadian Intellectual Property Office in corresponding Applicatin No. 2,571,697, 2 pages.

Search and Examination Report dated Jan. 30, 2009 issued by the U.K. Intellectual Property Office in corresponding Application No. GB0625087.2, 6 pages.

United Kingdom Combined Search and Examination Report for Appl. No. GB0504101.7; dated May 6, 2005; 6 pages.

* cited by examiner

METHOD OF MANUFACTURING A MATRIX BODY DRILL BIT

BACKGROUND OF INVENTION

1. Field of the Invention

The present invention relates to drill bits used in the oil and gas industry. Specifically, the invention relates to an improved method of manufacturing earth-boring bits for drilling earth formations.

2. Background Art

Drill bits are used in the oil and gas industry to drill earth formations in the exploration for gas and oil. FIG. 1 shows a drilling rig which incorporates a drill bit 101. Drill bit 101 is connected to the bottom of a drill string 103 to drill a wellbore 105. The drill string is controlled by surface equipment configured to rotate the drill string, apply downward force to the drill bit to penetrate the earth formation (referred to as weight on bit ("WOB")), and supply drilling fluid to drill bit 101 by pumping the fluid through a bore of the drill string. Because a variety of earth formations are penetrated in the pursuit of oil and gas, several different types and configurations of drill bits are used. These drill bits are usually grouped into two different categories, shear cutter bits and roller cone bits.

Shear bits are drill bits that cut the earth's formation by primarily scraping the earth formation when drilling. The shear bit is fixed to the drill string which is rotated so, as the drill string rotates, the bit also rotates to cut into the earth formation. The shear bit has a plurality of cutting elements arranged on the body of the drill bit such that the cutting elements scrape and shear the earth formation from the bottom and sides of the wellbore as the drill bit is rotated. Shear bits do not have any moving parts upon the bit itself, only the bit body moves from the rotation of the drill string.

Roller cone bits, in contrast, are drill bits having cones rotatably mounted onto journals. The roller cone bit typically has a bit body with at least one journal, in which a cone is mounted thereupon and allowed to rotate. As the bit body is rotated by the drill string, the cones rotatably contact the earth's formation. A plurality of cutting elements arranged on the roller cones crush and scrape the earth's formation as the bit is rotated. Even though both types of drill bits are useful for drilling into earth formations, only shear bits will be discussed from this point forward.

Shear bits can be further grouped into two categories: steel body bits and matrix body bits. Steel body bits typically have their heads machined from solid pieces of metal, typically steel. Upon completion of the machining, the remainder of the steel body bit is assembled with a bit shank. Usually shear bits use polycrystalline diamond compact ("PDC") cutters or some other type of wear resistant material to shear the earth formation.

In contrast, matrix body bits are constructed using a powder metallurgy manufacturing process. A cutter head mold of the desired bit head shape is constructed and filled with matrix powder and a binder. Next, the mold is placed in a furnace to allow the binder to melt and infiltrate the matrix powder. As the binder infiltrates the matrix powder, a solid metal casting is formed. The two general types of matrix body bits consists of bits which incorporate PDC cutters for cutting elements, and bits which incorporate natural diamonds impregnated in the matrix powder to shear the formation. In addition, bits may be manufactured with combinations of the two matrix bit body technologies. The focus of the remaining discussion will be directed toward matrix body bits.

Typically, the mold from the matrix body bits defines the external geometry of the bit head, as well as the internal hydraulic passageways. The external geometry of the mold defines the blade shape and junk slots of the bit head, the receptacles for cutters on the blades and on the blade body, and the drilling fluid nozzle orifices. The internal hydraulic passageways of the matrix body bit usually include nozzle ports and an internal fluid plenum. The internal hydraulic passageways of the matrix body bit are used to distribute the drilling fluid pumped through the drill string to various orifices on the face of the bit head. The plenum is generally defined as the internal volume from which all of the nozzle ports receive drilling fluid. The drilling fluid helps cool and clean the bit head, and also carries the cuttings away from the wellbore and back up to the surface.

Before the sintering process in manufacturing the matrix body bits, nozzle displacements and an internal plenum blank are set within the mold of the matrix body bit to form the internal hydraulic passageways. An internal plenum blank defines the internal plenum of the internal hydraulic passageways, and the nozzle displacements define the nozzle ports that will act as receptacles for the nozzles to be assembled with the bit later. Alternatively, the ports defined by the displacements are mere orifices through which the hydraulic fluid travels without the subsequent installation of nozzles. Nonetheless, the nozzle displacements are installed into the mold of the bit head and machined to create a plane, commonly referred to as an "interface plane", which is typically perpendicular to the bit centerline. The internal plenum blank is then installed at the interface plane to be adjacent to the nozzle displacements. The nozzle displacements are typically manufactured of graphite or cast sand, and the internal plenum blank is typically created as a sand casting. As expected, the plenum blank and the nozzle displacements are a negative representation of the internal hydraulic passageways within the matrix body bit, wherein the space occupied by the sand castings and graphite represent the volume of the internal plenum and nozzle ports to be created as a void within a sintered matrix body bit. Following the sintering process, the plenum blank and the nozzle displacements are chipped or machined out of the sintered matrix body bit to create this void.

Before the installation of nozzle displacements, the plenum blank is hand shaped from its original cone-shaped sand casting. An example of such a cone-shaped plenum blank 301 is shown in FIG. 2. Plenum blank 301 includes a pin section 303 and a bell section 305, with an interface plane 307 at the bottom of bell section 305. Before plenum blank 301 is shaped, it is positioned on top of the nozzle displacements such that interface planes of plenum blank 301 and the nozzle displacements are in contact. The location and shape of the nozzle displacements are then transferred by hand to the bottom of the plenum blank interface plane. Skilled workers then begin the process of hand shaping the sand cast plenum blank 301, removing material from bell section 305 to create the internal hydraulic passageways of the matrix body bit. An effective plenum blank will allow for drilling fluid to be efficiently transferred from the pin section down to the orifices on the face of the bit head through the nozzle ports.

The hand shaping of plenum blanks in manufacturing matrix bit bodies creates several issues. For instance, the design of the internal plenum and the transition from the internal plenum to the nozzle ports changes from bit to bit. Because the plenum blanks are hand shaped, each and every design for the plenum blanks is unique and subject to the skill level of the worker shaping the blank. The effectiveness of the hand shaped plenum blanks will therefore vary from pattern to pattern and are not repeatable. Additionally, as bit sizes and designs change, specific configurations and geometries of the plenum blank will need to change as well. An internal plenum design for one particular bit may work well, where the same design for another bit may encounter problems that lead to a washout from internal erosion or to a reduced bit life. Thus, even the most experienced and skilled craftsmen need to continuously refine their manufacturing techniques to accommodate the new bit designs.

Furthermore, the process of hand shaping the plenum blanks makes it difficult to identify problems with the internal hydraulic passageways of a particular bit. Designers cannot effectively analyze hand-shaped internal hydraulic passageways of the bit for improvement. As such, the internal plenum and transition areas to the nozzle ports cannot be reconstructed into a computer model for analysis. Therefore, plenum blanks with optimized transitions from the internal plenum to the nozzle ports are difficult to create. Such ineffective designs can easily occur if sufficient care is not taken by the worker to hand shape the transition region of the plenum blank properly.

Although methods for manufacturing matrix body bits have been successful in the prior art, further improvements may still be obtained by improving the repeatability characteristics and designs of the internal hydraulic passageways. In a market that is driven by using a drill bit multiple times, internal erosion can limit revenue by reducing the number of times a drill bit can be used and rebuilt. While PDC cutters can be replaced several times on a drill bit, the internal hydraulic passageways of a drill bit made from matrix powder are difficult to rebuild or replace. Thus, a method of manufacturing that allows a design to be made with repetition is desirable. Additionally, it is desirable for the method to allow a designer or engineer to design the interior components of a bit, analyze the design for improved performance, and manufacture the improved design.

SUMMARY OF INVENTION

In one aspect, the present invention relates to a method of manufacturing an earth-boring bit. The method includes constructing a plenum blank from a mold, wherein the plenum blank is configured to define an internal hydraulic passageway to conduct drilling fluid to an outer portion of the earth-boring bit, and creating the mold from a pattern. The method also includes positioning the plenum blank into a cavity of a bit head mold, wherein the bit head mold is configured to define the cutting structure and external geometry of the earth-boring bit. The method further includes at least partially filling the cavity with matrix powder and a binder, and sintering the matrix powder and binder to create a bit head casting of the earth-boring bit.

In another aspect, the present invention relates to a method of manufacturing an earth-boring bit having a fluid plenum and at least one fluid pathway. The method includes constructing a computer model of the flow characteristics through the fluid plenum and the at least one fluid pathway of the earth-boring bit, and determining a geometry to reduce fluid separation through the at least one fluid pathway. The method further includes constructing a plenum blank based upon the computer model, and sintering matrix powder between the plenum blank and a bit head mold to create the fluid plenum and at least one fluid pathway.

In another aspect, the present invention relates to an earth-boring bit. The earth-boring bit includes a bit body constructed of sintered matrix material cast from a bit body mold in conjunction with a plenum blank defining an internal fluid plenum of the earth-boring bit, and a plurality of fluid pathways extending from the internal fluid plenum to a plurality of fluid orifices of the bit body. The plenum blank is constructed from a mold constructed from a pattern, and the pattern is constructed using computer aided manufacturing techniques modeling techniques.

Other aspects and advantages of the invention will be apparent from the following description and the appended claims.

DETAILED DESCRIPTION

Figure 1:
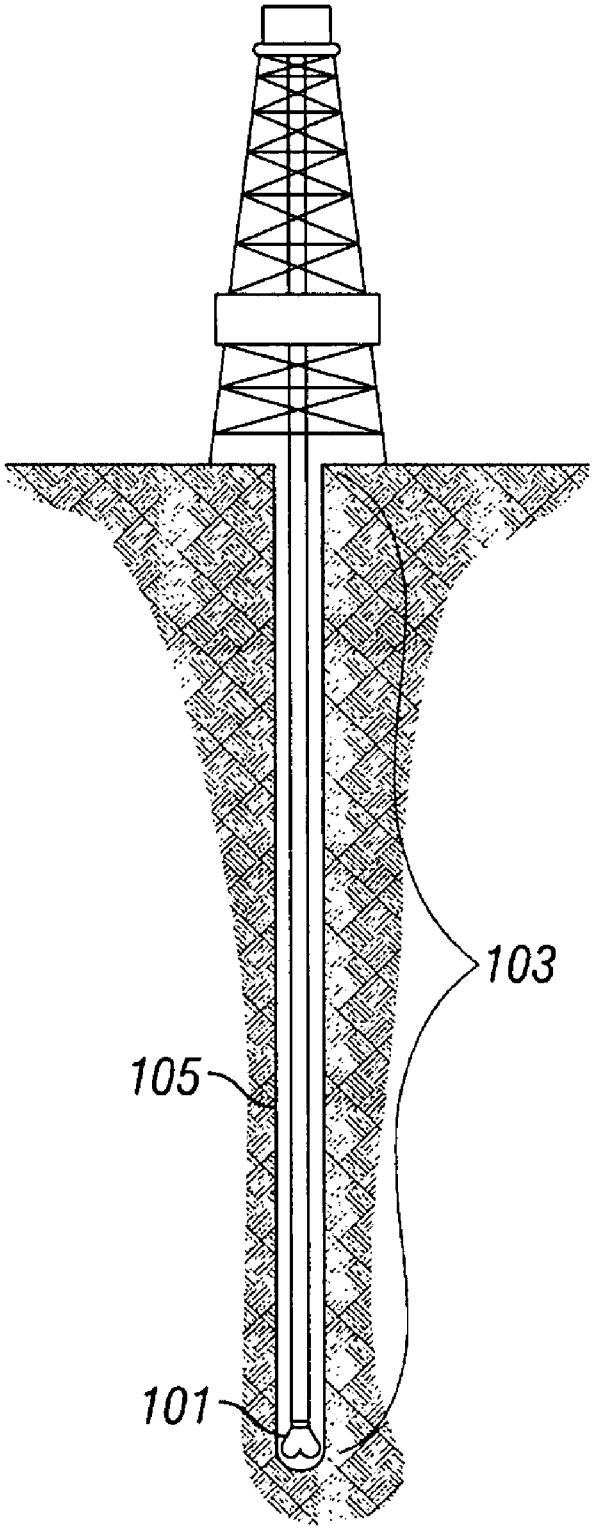
FIG. 1 is a schematic-view drawing of a drilling rig.
Figure 2:
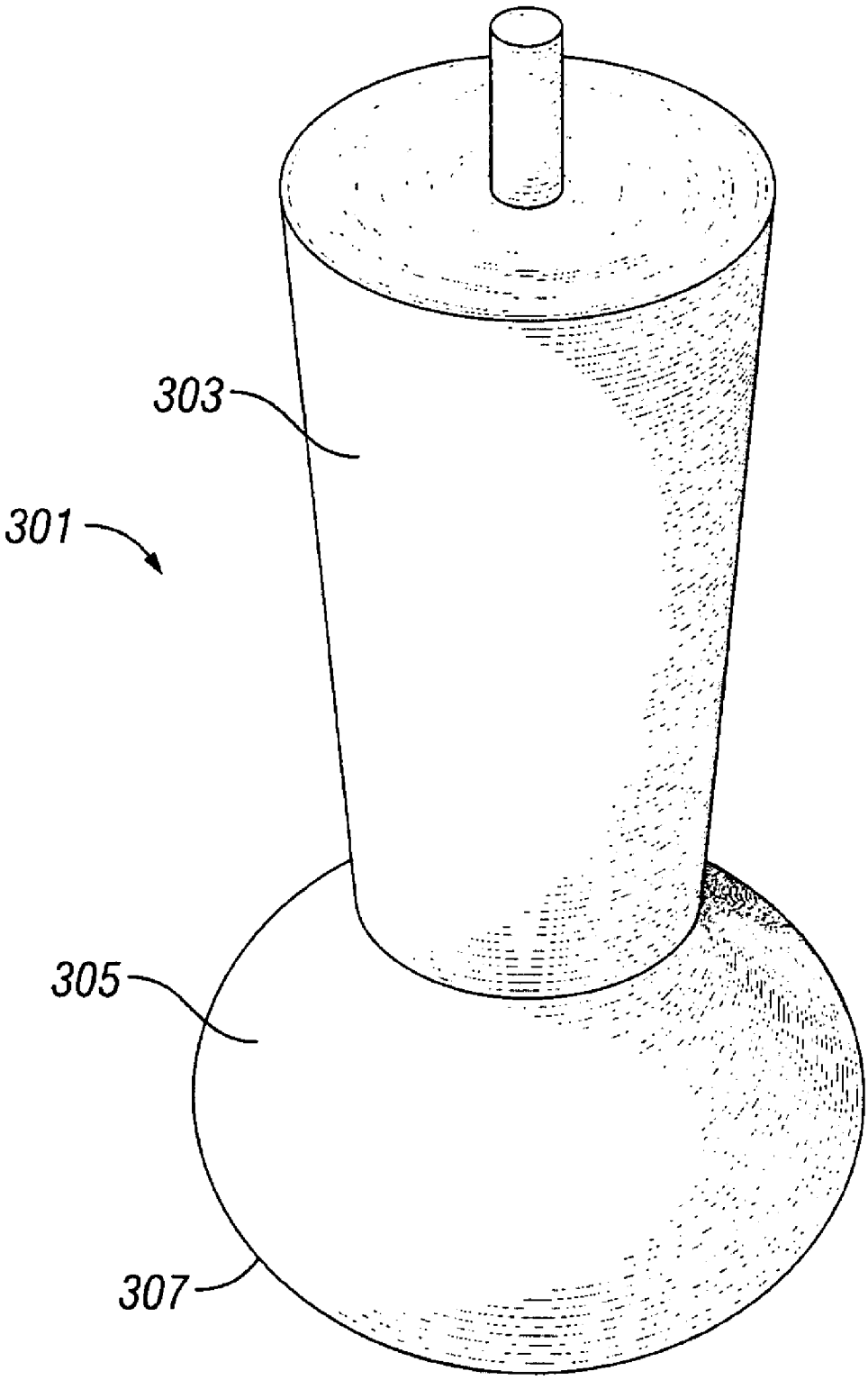
FIG. 2 is an isometric-view drawing of an unshaped plenum blank.
Figure 3:
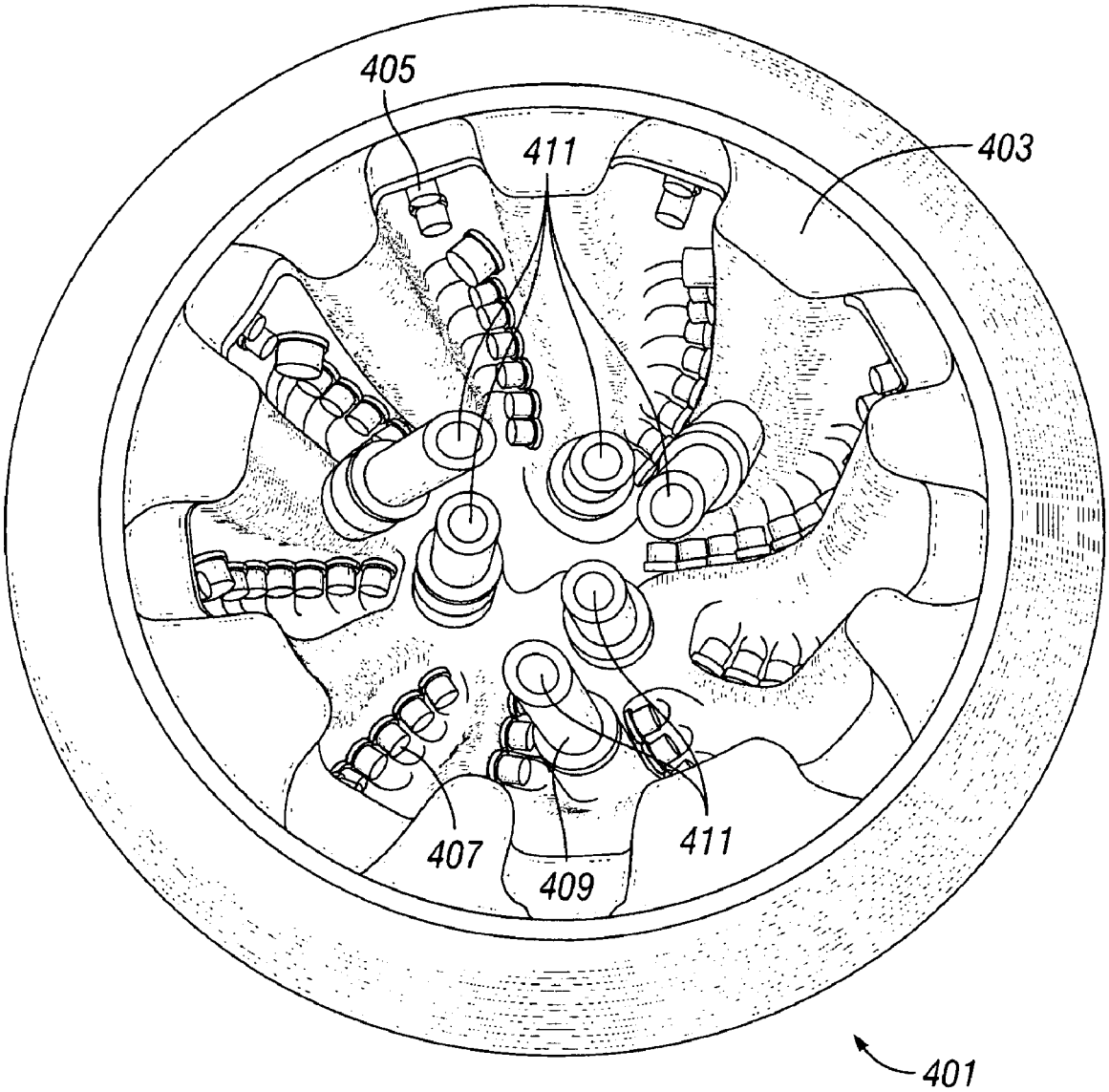
FIG. 3 is an isometric-view drawing of the inside of a mold of a matrix body bit in accordance with an embodiment of the present invention.

Referring now to FIG. 3, a bit head mold 401 formed in the shape of the external geometry of a matrix body bit is shown. The external geometry of bit head mold 401 includes junk slot geometry 403 and blade geometry 405. Cutter plugs 407 are positioned and glued in blade geometry 405 to create receptacles for later installation of PDC cutters. Furthermore, bit head mold 401 includes features to receive nozzle displacements 409. Nozzle displacements 409 define the necessary internal workings of a matrix body bit and may include seal glands, threads, sockets, or any other features used to seal and secure fluid nozzles in place. Alternatively, nozzle displacements 409 may only create space for a port to allow drilling fluid flow without any addition of a fluid nozzle. Preferably, nozzle displacements 409 are manufactured from graphite or cast sand such that the geometries of the internal hydraulic passageways created thereby are not distorted in the sintering process. After nozzle displacements 409 are installed into bit head mold 401, the tops of the displacements 409 are desirably machined to a common interface plane 411. While interface plane 411 is shown as perpendicular to the bit centerline, it should be understood by one of ordinary skill in the art that any orientation may be used. However, a single interface plane 411 facilitates the mating of a plenum blank with nozzle displacements 409. It should be further understood that while an interface plane 411 is disclosed, any non-planar surface shape can be machined for the interface between the fluid plenum and the nozzle displacements as long as it is capable of being matched between the plenum blank and the nozzle displacements. Furthermore, it should be understood that the nozzle displacements and the fluid plenum may be constructed as a single integral piece, wherein no interface surface exists.

Figure 4:
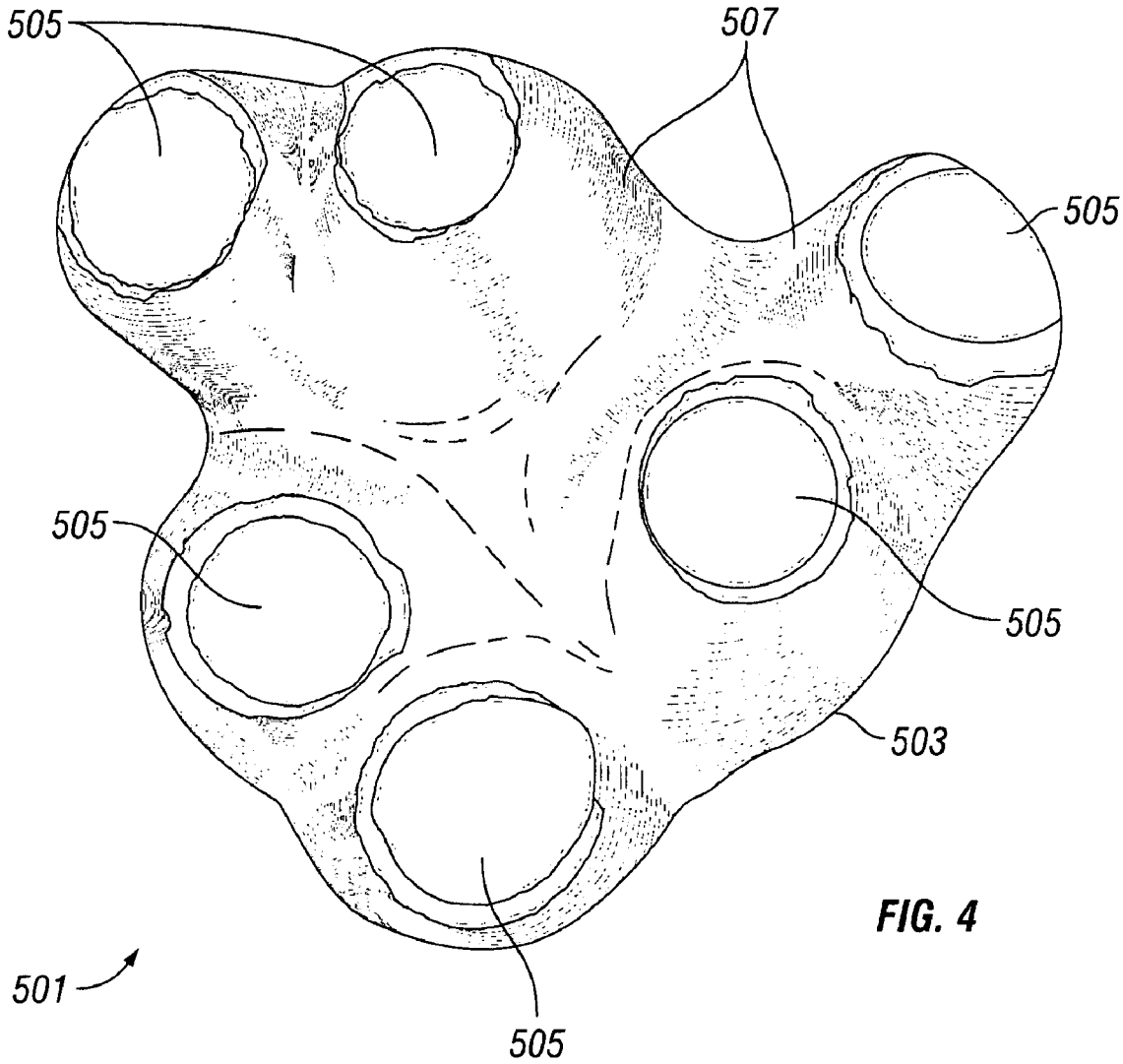
FIG. 4 is an isometric-view of a plenum blank to be used in conjunction with the mold of FIG. 3 in creating a matrix body bit in accordance with an embodiment of the present invention.

Referring now to FIG. 4, a plenum blank 501 used to create the internal plenum inside a matrix bit body is shown. Plenum blank 501 includes an internal plenum section 503 and a plurality of nozzle displacement interface sections 505 extending therefrom. As should be understood by one in ordinary skill in the art, plenum blank 501 is an inverse representation of a portion of the internal hydraulic passageways to be created within the matrix bit body. As such, space occupied by plenum blank 501 and nozzle displacements (409 in FIG. 3) represents the volume of the internal plenum and nozzle ports to be created as a void within a sintered matrix bit body. While plenum blank 501 may be constructed as a sand casting or ceramic casting material, it should be understood that any material capable of withstanding the heat and stresses of the sintering process while remaining dimensionally stable can be used.

Though nozzle displacements 409 of FIG. 3 create the orifices in the face of the matrix body bit for communication of drilling fluid to the wellbore in the earth formation, nozzle displacement interface sections 505 create the pathways and transitions from internal fluid plenum section 503 to those fluid orifices. Therefore, in one embodiment, nozzle displacement interface sections 505 of plenum blank 501 include transition sections 507. Transition sections 507 can be formed into plenum blank 501 to maximize the flow efficiency of drilling fluid from the internal plenum to the nozzle ports of the internal hydraulic passageways. To maximize flow efficiency, the transition sections need to minimize the flow separation zones occurring in the internal hydraulic passageways, particularly in the areas of the entrances of the nozzle ports. The transition sections may vary in shape, size, or location, so long as they reduce the flow separation zones.

Figure 5:
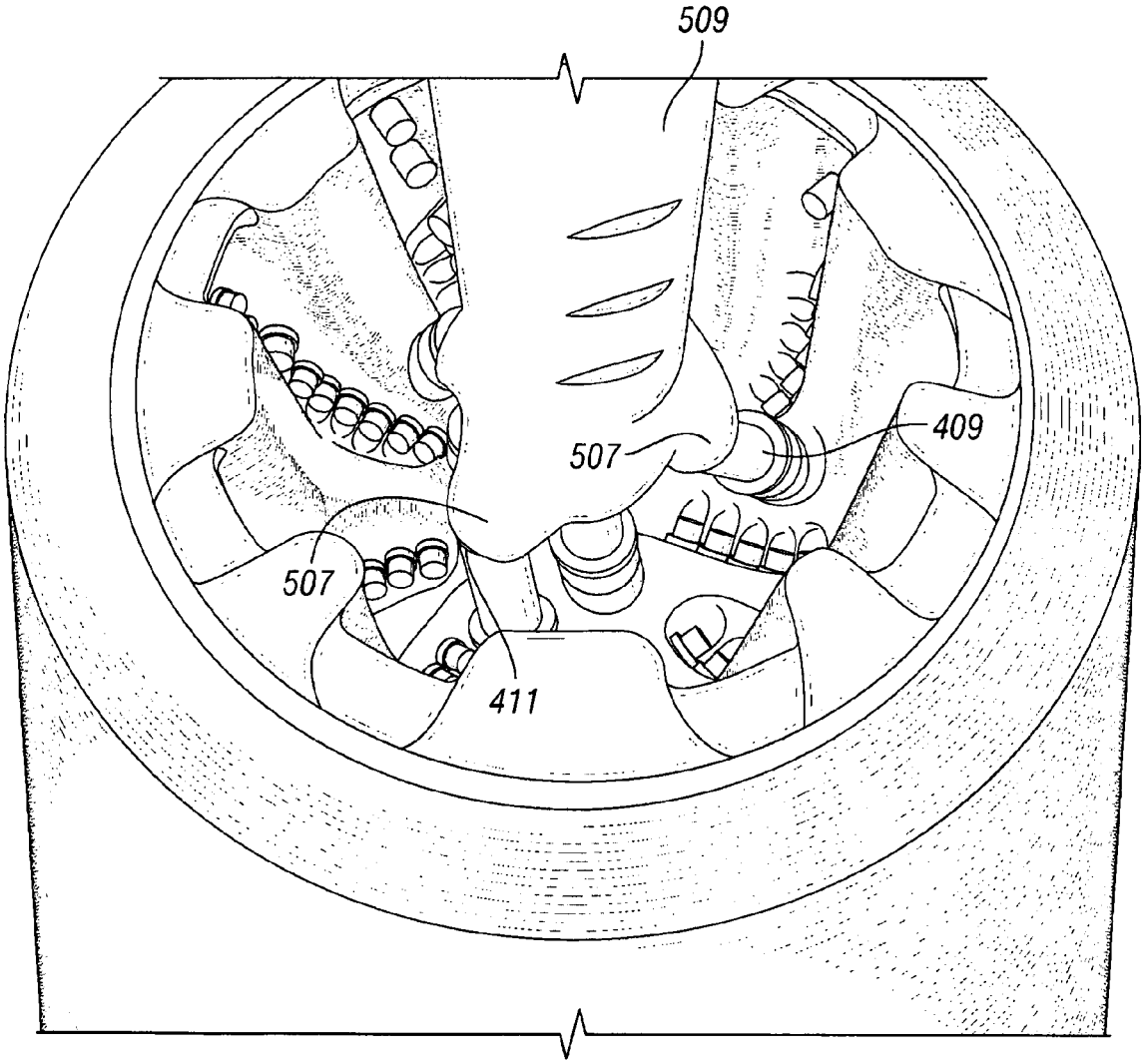
FIG. 5 is an isometric-view of the plenum blank of FIG. 4 in place within the mold of FIG. 3.

Referring now to FIG. 5, plenum blank 501 is installed into bit head mold 401. Plenum blank 501 is installed adjacent to nozzle displacements 409 such that interface plane 411 of nozzle displacements 409 is aligned with nozzle displacement interface sections 505 of plenum blank 501. This mating creates the internal hydraulic passageways of a matrix body bit formed from the bit head mold 401. Additionally, cylindrical section 509 of plenum blank 501 creates the throughbore extending through the bit shank of the matrix body bit for communication with the bore of the drill string. Again, it should be understood by one of ordinary skill in the art that nozzle displacements 409 and plenum blank 501 may be constructed as a single integral unit, with no interface plane therebetween.

Figure 6:
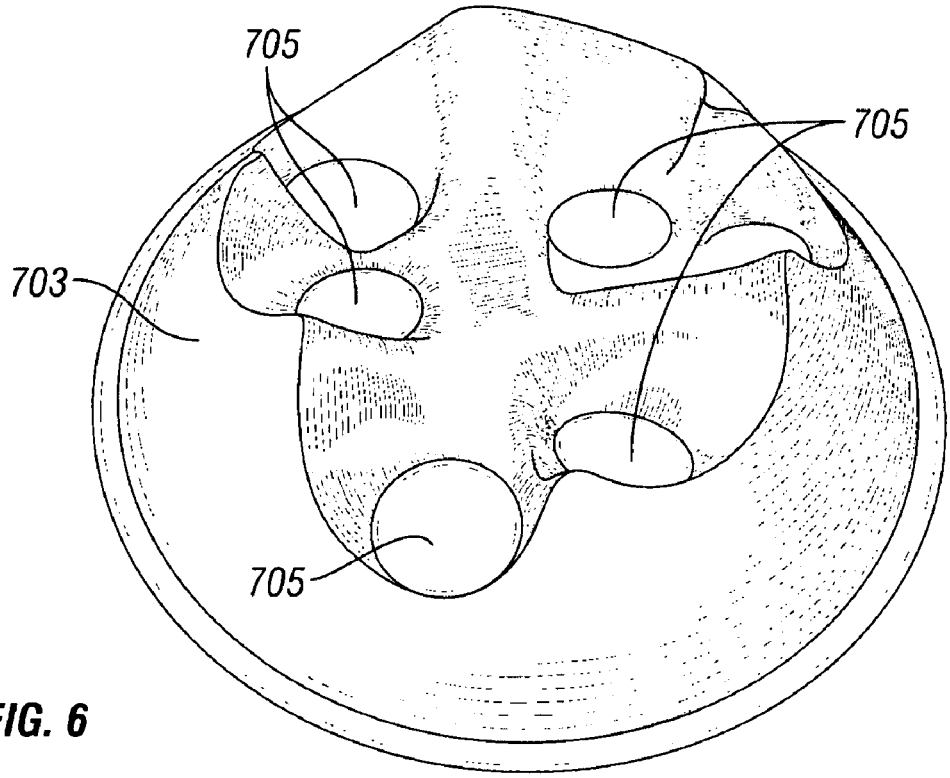
FIG. 6 is an isometric-view of a lower section of a mold used in the creation of the plenum blank of FIG. 4.
Figure 7:
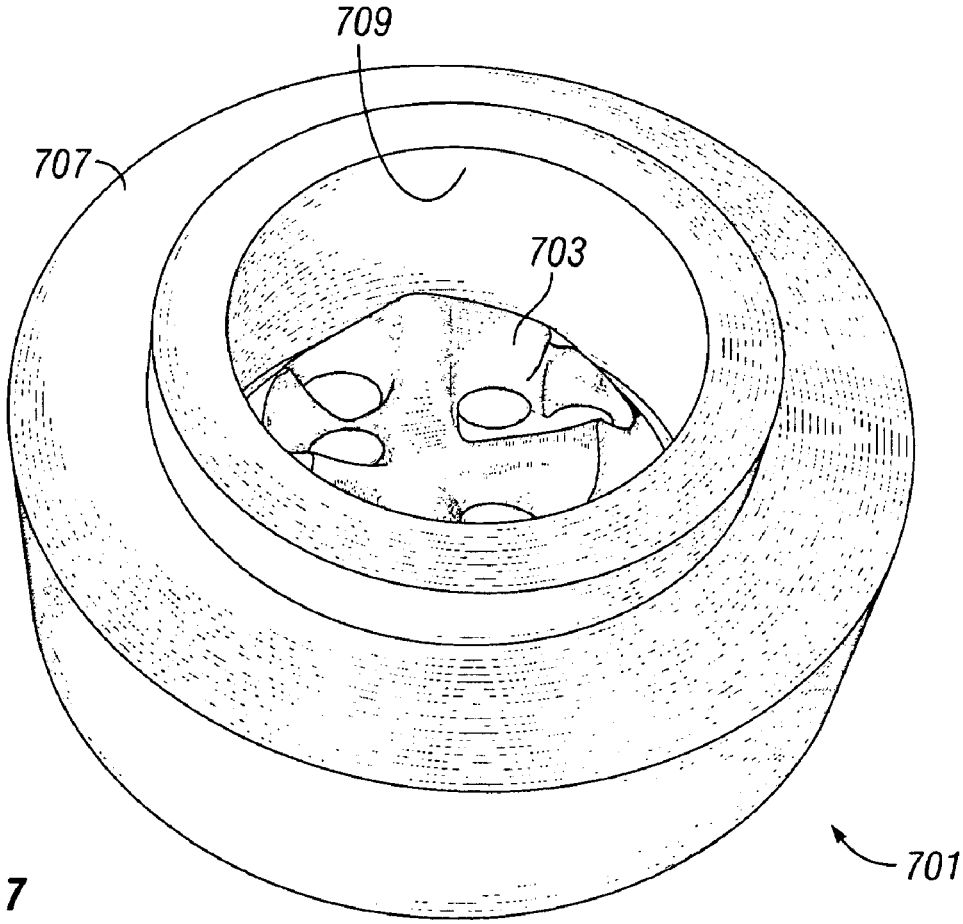
FIG. 7 is an isometric-view of the lower section of a mold of FIG. 6 and an upper section of a mold assembled and used in the creation of the plenum blank of FIG. 4.

Referring now to FIGS. 6 and 7 together, a mold assembly 701 used to create plenum blank 501 of FIG. 4 is shown. FIG. 6 shows a lower mold section 703, including a plurality of cavities 705 corresponding to nozzle displacement interface sections 505 and transition sections 507 formed on plenum blank 501. In FIG. 7, mold assembly 701 is shown in an assembled state with upper mold section 707 resting on top of lower mold section 703. Cylindrical opening 709 allows for cylindrical section 509 of plenum blank 501 to be constructed as long as desired by further adding cylindrical sections (not shown) to mold assembly 701. Generally, mold assembly 701 is used to create a sand casting from plenum blank 501. Typically, sand and a binder are placed into mold assembly 701 and placed in a furnace or oven at an appropriate temperature to solidify the sand into a single component to be used in the matrix body bit mold. Using mold assembly 701, numerous sand castings of plenum blank 501 may be constructed in a process that is faster and more repeatable than hand shaping individual plenum blanks, as discussed above.

Figure 8:
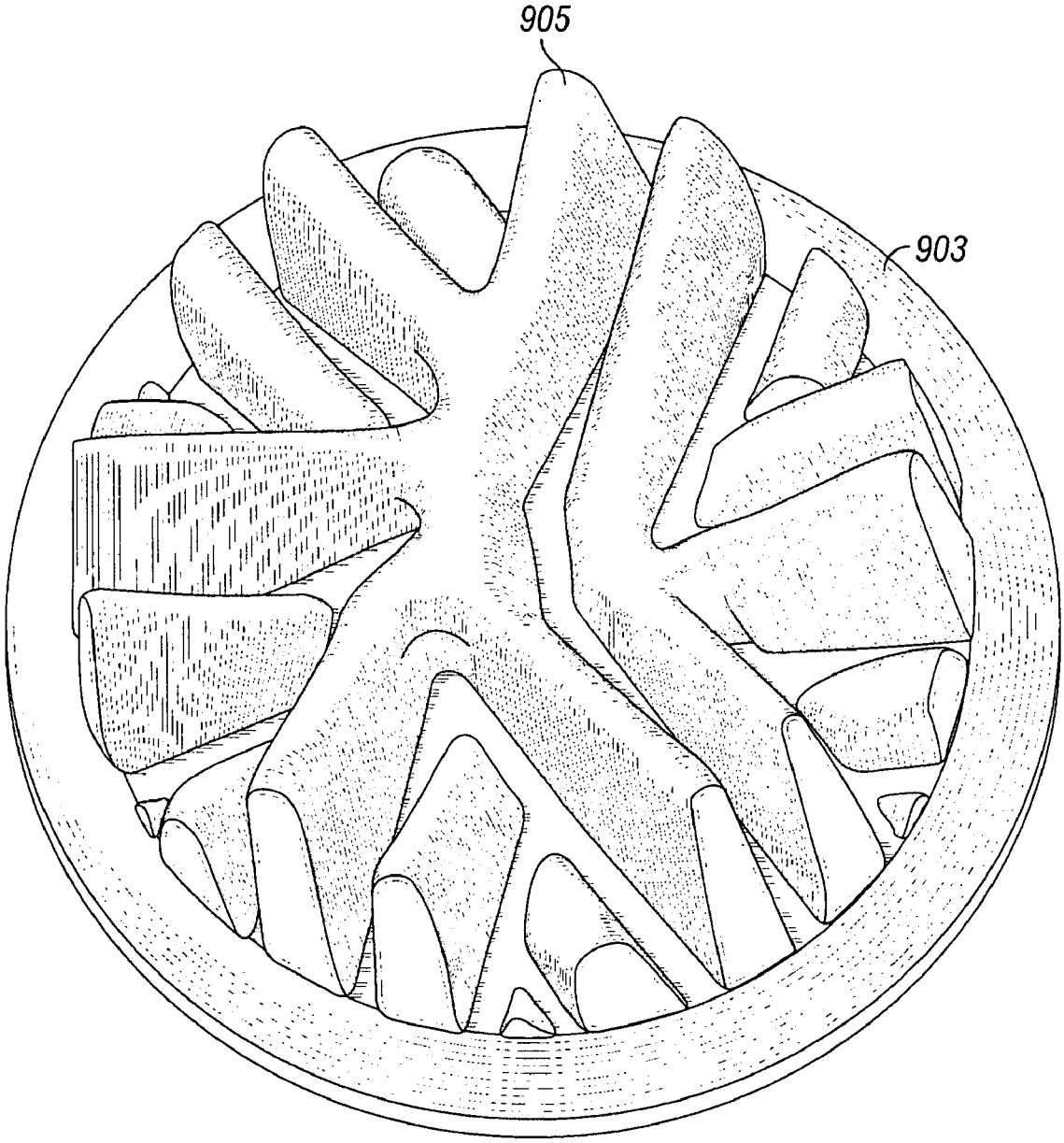
FIG. 8 is an isometric-view of the lower section of a mold used in the creation of a natural diamond impregnated bit in accordance with an embodiment of the present invention.

Referring now to FIG. 8, a plenum mold 903 used to create fluid passageways in a natural diamond bit is shown. Mold 903 includes a plurality of protrusions 905, that define fluid passages in the created natural diamond bit. In a natural diamond drill bit, the plenum inside the bit body does not interface with nozzle displacements, as with a PDC bit. Instead, the plenum communicates with the external geometry of the drill bit, through which the fluid slots clean the surfaces embedded with the natural diamond.

Several methods can be employed to manufacture a plenum blank to be used in casting a drill bit as described above. In one method, a pattern, or an exact replica of the plenum blank, is created. Once the pattern is created, a mold can be manufactured from this pattern. Finally, the mold is used to create numerous plenum blank replicas of the original pattern to be used in creating matrix drill bits. The processes through which the pattern, the mold, and the plenum blank replicas are created can be varied. One such process includes the creation of the pattern of the plenum blank through hand shaping techniques. One drawback to hand shaping of the pattern is the amount of time and skill required to complete the pattern. Highly skilled workmanship is required to properly shape transition sections 507 to align with nozzle displacements 409 in bit head mold 401. Additionally, as mentioned above, as the designs and configurations for the bits to be created change, the geometries and configurations of the pattern will as well.

Alternatively, the pattern of the plenum blank may be created through computer aided drafting and computer aided manufacturing ("CAD/CAM") techniques. In a typical CAD/CAM process, a bit designer will use experience and design analysis to design a three-dimensional computer model representing the plenum blank and the internal passageways that carry the fluid from the center of the bit to the external portions of the bit. Once the CAD model is constructed, various analysis processes can be performed utilizing the computer model. Particularly, in the case of a plenum blank and nozzle displacements, computational fluid dynamics ("CFD") analysis can be performed to evaluate and improve the internal geometry and orientation of the fluid passageways. Generally, this is an iterative process where a CFD analysis is performed on a baseline model. Once the analysis is complete on the baseline model, it is modified to effect a change in the flow characteristics and hopefully to improve the flow field. Changes to the models may include, but are not limited to, the plenum blank design, the nozzle bore orientation and location, the distance between the plenum blank and the outside of the bit, and the geometry of transition regions between the plenum blank and the nozzle displacements.

After an internal passageway design is selected, a pattern must be created to construct the mold. When building the pattern, it is desirable to utilize manufacturing technologies that use the CAD model to build the pattern. Two methods of manufacturing high quality patterns from the CAD model use rapid prototyping (RP) machines and computer numerical control ("CNC") machines. Rapid prototype machines utilize special output files from the CAD software to build a solid model. Depending on the manufacturer and machine type, different types of materials may be used to build the part including, but not limited to, corn starch, wax polymers, epoxy resins, or powder metallurgy. Rapid prototype technology has the advantage of being able to quickly manufacture a designed component with complex geometries at high tolerances. However, one drawback of RP manufacturing, depending on the material used, is that the components are typically manufactured from materials having low melt temperatures that make the models dimensionally unstable at elevated temperatures. In this case, the RP output is used as a pattern to create a mold. If a more thermally stable material is used, then the mold can be made directly by the RP machine, skipping the pattern stage altogether. In contrast, CNC machines have the advantage of being less limited in the size of the part but generally require more time to build due to programming requirements and machining time. However, components manufactured from CNC machinery can be machined to high tolerances and out of materials (e.g. steels, aluminum, etc.) that are more dimensionally stable at temperature than RP components.

Once the mold pattern is built, it is used to fabricate a mold to replicate patterns for installation in the bit head mold. A mold is desirably constructed of a material that is more durable and dimensionally stable at the temperatures required to cure the casting material. A mold may be constructed by creating a structurally stable shell around the pattern using materials known to those of ordinary skill in the molding industry. These materials can include, but are not limited to, powder metallurgical materials, ceramics, epoxies, RTV silicones, liquid rubber, or any other mold making material known to one of ordinary skill. Desirably, such a material would be hardenable either at room temperature or at a temperature within the dimensionally stable capabilities of the pattern (i.e. below the melting temperature of the RP media). For example, REPLICAST 101 (available from Cotronics Corporation) is pourable liquid that is capable of being used to create precision rubber molds after a 24 hour cure at room temperature. In the case of some ceramic and epoxy casting materials, the materials firm up at room temperature but are permanently set after going through a curing process at elevated temperatures. Typically, the molds are set up with parting lines that allow the separation of the mold to remove completed patterns. Once the mold is hardened around the pattern, the pattern is removed from the mold. Optionally, if the pattern is of a complex geometry not easily removed from the mold, it can be removed by increasing the temperature to melt the RP material and pour it from the mold. However, such a process would require the creation of additional RP patterns should additional molds be desired. Once completed, each mold can be used to create numerous plenum blanks to be used in conjunction with bit head molds to create matrix drill bits.

This approach to bit design and manufacture benefits the bit designer as a pattern for the mold can be readily constructed from the CAD model and used consistently and repeatedly to construct the internal passageways corresponding to the designated internal geometry. Therefore, the design and construction of matrix bits in accordance with embodiments of the present invention improves consistency in the manufacturing and performance of drill bits. Furthermore, the product development cycle may be shortened as failure modes will be more consistent from bit to bit, thus improving the designer's ability to identify and analyze problems with the design so that the internal geometry can be changed to improve bit performance and internal flow characteristics.

Furthermore, once the bit geometry is created and modeled in a computer system, hydraulic modeling and analysis techniques may then be applied to determine an optimized location for the fluid orifices on the face of the drill bit to maximize fluid flow and cutting performance. Once location is determined, hydraulic modeling and analysis techniques may then be used to determine the optimal geometry of the internal fluid plenum and fluid passageways. Such an optimized model may include the transition regions from the internal plenum to the nozzle ports so as to minimize fluid separation therethrough during operation. With the characteristics and placement of the internal hydraulic passageways optimized, data from the computer model may be exported to a RP (or any other computer assisted manufacturing device) machine to manufacture a pattern.

Alternatively, a mold can be built directly utilizing an RP or CNC machine, eliminating the need for a pattern altogether. Such machines allow the design of a three-dimensional model for a plenum blank in a computer aided design environment. Once designed, the CAD model can be manipulated and outputted to the RP machine to quickly build sections of the mold. Once built, plenum blanks can be produced as outlined above.

Alternatively, a plenum blank can be manufactured directly by a resin rapid prototype or CNC machine. Alternatively still, a person skilled in the art may combine any of the methods above.

Referring now to FIGS. 9, 10, 12, and 13, contour plots generated with CFD analysis software to use a computer to model the fluid flow characteristics of the internal hydraulic passageways of drill bits are shown. Specifically, the contour plots utilize computational fluid dynamics analysis to model the fluid flow and behavior through the internal plenum and nozzle ports of the internal hydraulic passageways. In the Figures, lighter regions represent regions of higher fluid velocity adjacent the surface than darker regions. Fluid separation is therefore evidenced by slower darker flow regions and lighter regions represent flow with a higher velocity. The darker regions experiencing flow separation are at a much higher risk of premature wear and internal erosion from that of flow in lighter regions. Utilizing such data from fluid velocity models, designers and engineers may alter the geometries of internal hydraulic passageways within drill bits to reduce flow separation regions and increase bit longevity.

Figure 9:
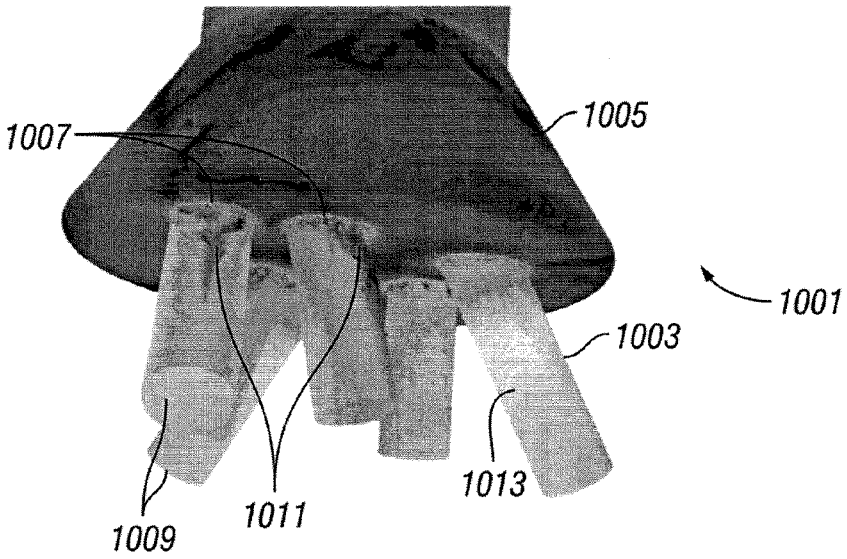
FIG. 9 is a schematic-view of a velocity contour plot of an internal hydraulic passageway, including the internal plenum and the nozzle ports in accordance with an embodiment of the present invention.
Figure 10:
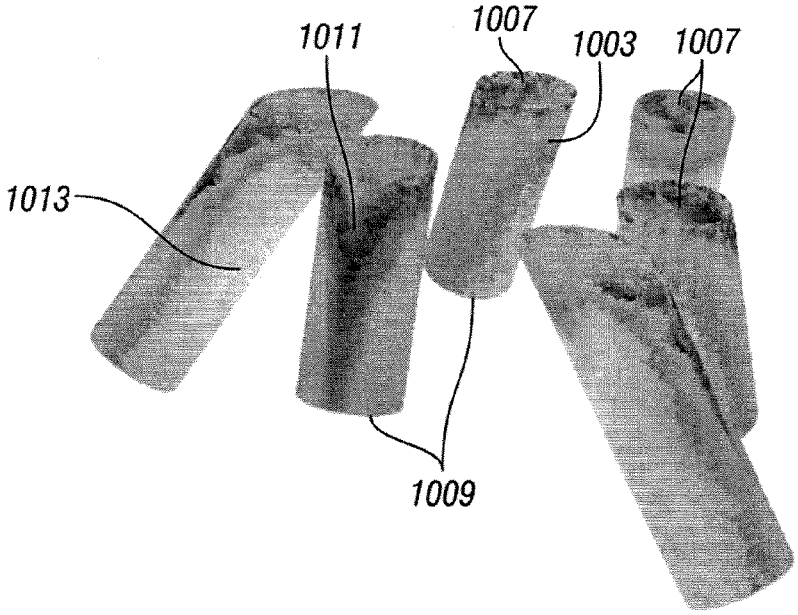
FIG. 10 is a velocity contour plot of only the nozzle ports of FIG. 9.

Referring specifically to FIGS. 9 and 10, velocity contours for internal hydraulic passageways 1001 of a matrix body bit are shown. Internal hydraulic passageways 1001 include nozzle ports 1003 and internal plenum 1005. In each nozzle port 1003, fluid flows from plenum 1005, through an upper portion 1007 of nozzle port 1003, and out a lower portion 1009 of nozzle port 1003. Dark areas 1011 of contour plot represent separated low-velocity fluid flow and lighter areas 1013 represent faster non-separated regions. Because several nozzle ports 1003 display significant darker areas 1011, it is desirable to improve the configuration of nozzle ports 1003 to decrease the flow separation. Decreased flow separation results in decreased internal erosion and increased life of the bit.

Figure 11:
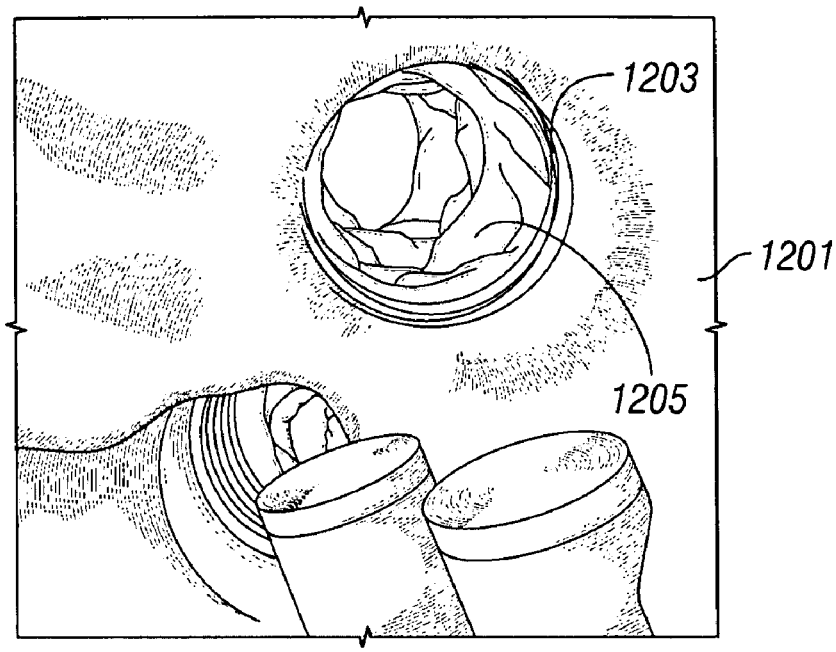
FIG. 11 is an example of internal erosion resulting in a drill bit from flow separation.

Referring now to FIG. 11, an example of internal erosion 1205 in a drill bit 1201 is shown. Internal erosion 1205 results in drill bit 1201 from separated low-velocity fluid flow through internal hydraulic passageways. Specifically, internal erosion 1205 occurs in the nozzle port 1203 of drill bit 1201. Typically, internal erosion of such magnitude occurs when the fluid in the internal hydraulic passageways makes an inefficient transition from the internal plenum to the nozzle ports. The inefficient transition from the internal plenum to the nozzle ports can be created from either the fluid having to change directions abruptly or in circumstances where the angle transition from the internal plenum to the nozzle port is too large. Internal erosion 1205 results in nozzle port 1203, due to the turbulent flow and cavitation generated in the fluid separation areas.

Figure 12:
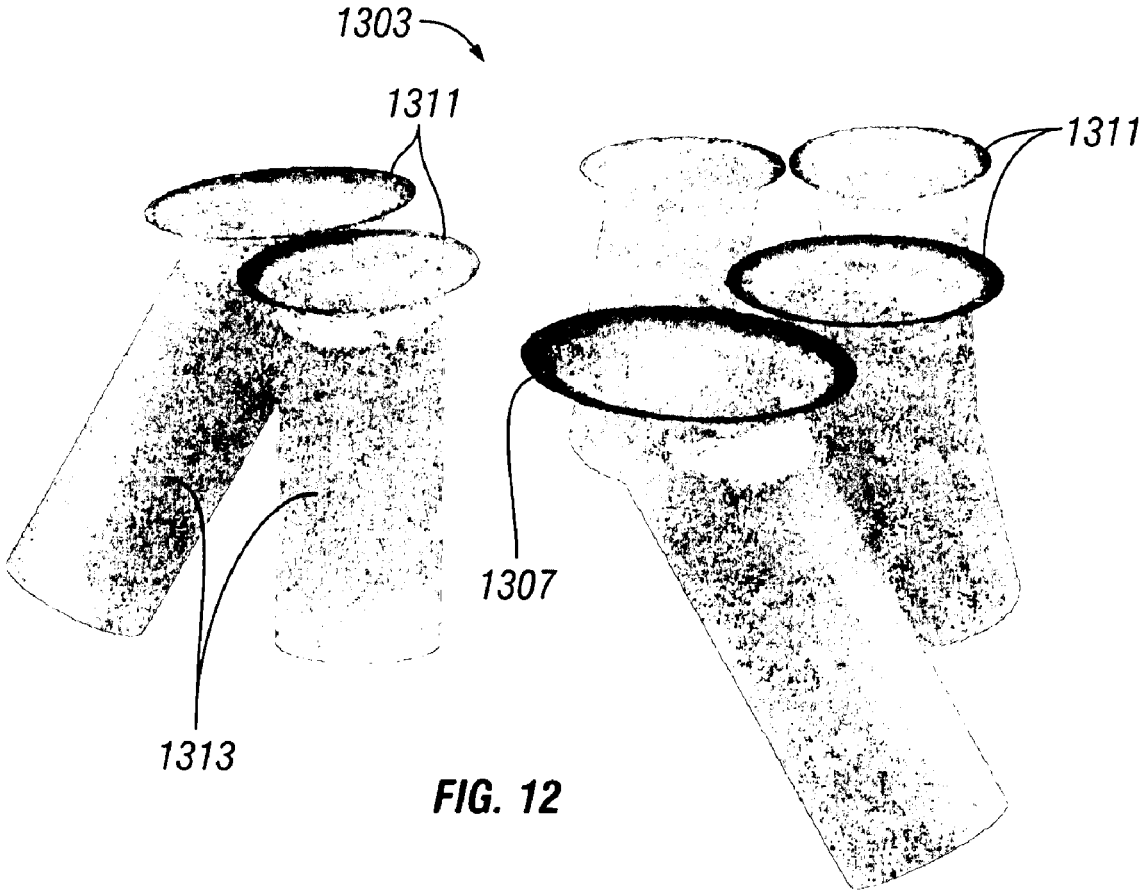
FIG. 12 is a velocity contour plot of nozzle ports with radiused entrances in accordance with an embodiment of the present invention.

Referring now to FIG. 12, a velocity contour plot for nozzle ports 1303 with radiused entrances 1307 is shown. Radiused entrances 1307 are shown located at the intersection between the plenum (not shown) and nozzle ports 1303 in the internal hydraulic passageway of the drill bit. Radiused entrances 1307 provide a swept region completely surrounding the intersection between the plenum and nozzle ports 1303. In comparison to the contour plots of FIG. 10, the contour plots of FIG. 12 show only isolated dark areas 1311 of flow separation that are much smaller than dark areas 1011 of FIG. 10. Additionally, lighter areas 1313 representing non-separated fluid flow are much more prominent in nozzle ports 1303 than compared to lighter areas 1013 of nozzle ports 1003 in FIG. 10.

Figure 13:
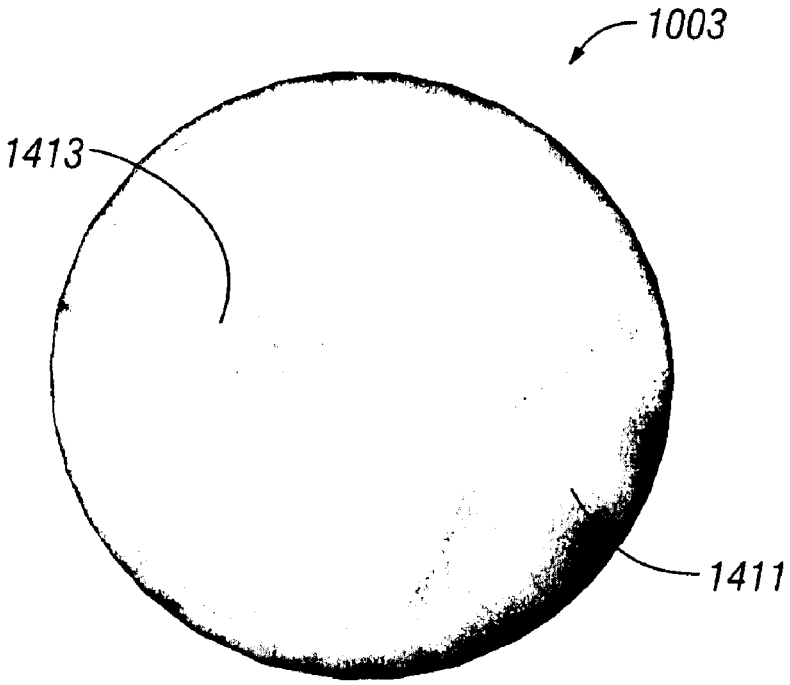
FIG. 13 is a velocity contour plot of a cross-section taken from the nozzle ports of FIGS. 9 and 10.
Figure 14:
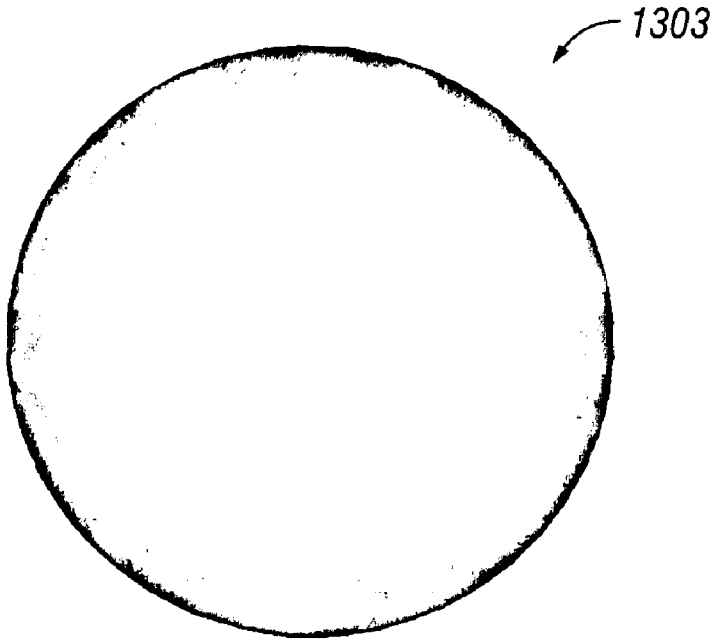
FIG. 14 is a velocity contour plot of a cross-section taken from the nozzle ports of FIG. 12.

Referring now to FIGS. 13 and 14, a cross-sectional comparison of non-radiused entrance nozzle port 1003 with radiused entrance nozzle port 1303 is shown. The cross-sectional views shown in the Figures are taken across the same planes in nozzle port 1003 and nozzle port 1303 with respect to each other. In FIG. 13, a large dark area 1411 of low-velocity fluid flow and flow separation is shown. Dark area 1411 has the effect of artificially reducing the area of nozzle port 1003 and increasing the fluid flow velocity in area 1413. This results in a non-uniform, turbulent fluid flow through nozzle port 1003, leading to internal erosion. In FIG. 14, radiused nozzle port 1303 shows no significant dark areas in the fluid flow. The radiused entrance on nozzle port 1303 significantly reduces the flow separation previously present in nozzle port 1003 of FIG. 13. Therefore, nozzle port 1303 allows an overall lower fluid flow velocity across the cross-sectional area because the entire area is effectively used to transport fluid.

Radiused entrances 1307 are examples of transition regions formed in the internal hydraulic passageways of a drill bit. Transition regions provide a more uniform fluid velocity, which results in a significant reduction in turbulent flow and flow separation zones in the internal hydraulic passageways. Therefore, with transition regions, internal hydraulic passageways can prevent internal erosion and washouts from occurring inside of drill bits, effectively extending the life of a drill bit. Other examples of transition regions may also be used for the internal hydraulic passageways of a drill bit. Alternatively, the transition region can be a radiused entrance formed only partially around the entrance of the nozzle port. Alternatively still, the transition region can be radiused entrances formed in several different areas around the entrance of the nozzle port. Those of ordinary skill in the art will appreciate that many different shapes and forms can be used for the transition region without departing from the scope of the present invention.

Embodiments of the present invention have the following advantages. Using patterns and molds to create plenum blanks to be used in the manufacturing process of a drill bit permits for repeatability and consistency in the created plenum blanks and drill bits. The plenum blanks from the same mold will have the same size and shape, and therefore define the same internal hydraulic passageways in a drill bit. Additionally, the reusable mold for the plenum blanks is more time efficient and less costly than previous methods. A manufacturing process utilizing the mold will be able to create many more plenum blanks than a process that makes each blank one at a time. As well, the method of manufacturing in the present application allows for designers to create an internal plenum in a drill bit with transition sections from an improved or optimized design in a CAD/CAM system in a cost and time effective manner. The internal plenum, transition regions, and nozzle ports of an internal hydraulic passageway can be analyzed and improved or optimized in a CFD analysis package, wherein the design can be implemented into a repeatable cost-effective manufacturing process for a drill bit.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method to manufacture an earth-boring bit having a fluid plenum and at least one fluid pathway, the method comprising:

constructing a computer model of the fluid plenum and at least one fluid pathway;

determining the flow characteristics though the fluid plenum and the at least one fluid pathway of the earth-boring bit based on the computer model;

optimizing the flow characteristics though the fluid plenum and the at least one fluid pathway;

creating a mold pattern based on the optimized computer model;

forming at least one plenum blank using the mold pattern; and sintering matrix powder between the plenum blank and a bit head mold to create the earth-boring bit having the fluid plenum and the at least one fluid pathway.

2. The method of claim 1, wherein the creating a mold pattern comprises using at least one of the group consisting of CAD/CAM techniques, rapid prototyping, and CNC machinery to create the pattern for the plenum blank.

3. The method of claim 1, wherein using the mold pattern to form the plenum blank comprises:

creating a mold from the mold pattern; and using the mold to form the plenum blank.

4. The method of claim 1, wherein the constructing the plenum blank based upon the computer model comprises constructing a mold pattern for forming the plenum blank based on the model using at least one selected from the group consisting of a CNC machine and a rapid prototype machine.

5. The method of claim 1, wherein the optimizing the flow characteristics comprises reducing fluid separation through the at least one fluid pathway.

6. A method to manufacture an earth-boring shear bit, the method comprising:

creating a computer model of internal hydraulic passageways of an earth-boring shear bit using computer aided design, wherein the internal hydraulic passageways comprise at least a fluid plenum and pathways from the fluid plenum to external portions of the bit;

optimizing flow characteristics through the fluid plenum and the pathways;

creating a mold pattern using computer aided manufacturing based on the optimized computer model;

forming a mold using the mold pattern;

forming a plenum blank from the mold that includes pathway transition sections based on the optimized computer model;

positioning the plenum blank into a cavity of a bit head mold, wherein the bit head mold is configured to define the cutting structure and external geometry of the earth-boring shear bit; and sintering matrix powder and binder in the cavity to form a bit head casting of the earth-boring shear bit.

7. The method of claim 6, wherein said model is optimized by evaluating fluid flow through the internal passageways using computational fluid dynamics and adjusting a geometry of the internal passageways to improve the fluid flow.

8. The method of claim 7, further comprising determining a geometry of the internal passageways using computational fluid dynamics.

9. The method of claim 8, further comprising optimizing the geometry of the internal passageways using computational fluid dynamics.

10. The method of claim 6, wherein the computer aided manufacturing comprises rapid prototyping.

11. The method of claim 6, wherein the computer aided manufacturing comprises machining with a CNC machine.

12. The method of claim 6, wherein the plenum blank is constructed from cast sand.

13. The method of claim 6, wherein the plenum blank is constructed of ceramic casting material.

14. The method of claim 6, wherein the mold is constructed out of ceramic casting material.

15. An earth-boring shear bit manufactured from the method of claim 6.

16. The method of claim 6, wherein the optimizing flow characteristics through the fluid plenum and the pathways comprises reducing fluid separation through the pathway transition sections.

* * * * *